US010123596B2

(12) United States Patent
King

(10) Patent No.: US 10,123,596 B2
(45) Date of Patent: Nov. 13, 2018

(54) ADJUSTABLE WALLET

(71) Applicant: TRAYVAX ENTERPRISES LLC, Bellingham, WA (US)

(72) Inventor: Mark King, Bellingham, WA (US)

(73) Assignee: TRAYVAX ENTERPRISES LLC, Bellingham, WA (US)

( * ) Notice: Subject to any disclaimer, the term of this patent is extended or adjusted under 35 U.S.C. 154(b) by 197 days.

(21) Appl. No.: 15/335,099

(22) Filed: Oct. 26, 2016

(65) Prior Publication Data

US 2017/0119115 A1 May 4, 2017

Related U.S. Application Data

(60) Provisional application No. 62/247,442, filed on Oct. 28, 2015.

(51) Int. Cl.

| | |
|---|---|
| ***A45C 1/06*** | (2006.01) |
| ***A45C 13/30*** | (2006.01) |
| ***A45C 11/18*** | (2006.01) |

(52) U.S. Cl.

CPC ..... *A45C 1/06* (2013.01); *A45C 11/182* (2013.01); *A45C 13/30* (2013.01); *A45C 2001/065* (2013.01); *A45C 2001/067* (2013.01); *A45C 2011/186* (2013.01)

(58) Field of Classification Search

CPC ..... A45C 1/06; A45C 11/182; A45C 13/30; A45C 2001/065; A45C 2001/067; A45C 2011/186

See application file for complete search history.

(56) References Cited

U.S. PATENT DOCUMENTS

| | | | |
|---|---|---|---|
| 956,534 | A | 5/1910 | Lahey |
| D189,333 | S | 11/1960 | Hayden |
| 3,970,129 | A | 7/1976 | Tepfer |
| D314,865 | S | 2/1991 | Tuisku |
| D377,713 | S | 2/1997 | Chandler |
| 5,944,080 | A | 8/1999 | Podwika |
| 6,357,084 | B1 | 3/2002 | Haidon |
| D575,506 | S | 8/2008 | Huang |
| D630,848 | S | 1/2011 | Long |
| D663,951 | S | 7/2012 | Flores |
| D688,865 | S | 9/2013 | Tsai |
| D705,210 | S | 5/2014 | Adelman |
| D716,043 | S | 10/2014 | Wilk |
| 9,125,464 | B2 | 9/2015 | Minn |

(Continued)

OTHER PUBLICATIONS

Trayvax Original Wallet [online image]. Retrieved from Kickstarter website May 7, 2013 at https://www.kickstarter.com/projects/1262752680/trayvax-wallet-for-life.

(Continued)

*Primary Examiner* — Tri Mai

(74) *Attorney, Agent, or Firm* — FisherBroyles, LLP; Jason M. Pass

(57) ABSTRACT

An adjustable wallet is provided. The wallet has a first plate and a second plate spaced from and overlying the first plate. A cord couples the distal ends of the plate together a predetermined, adjustable distance apart. A first strap selectively couples the proximal ends of the plates together to secure the wallet in a closed position. A second strap having an adjustable body length secures the personal items of a user to the second plate.

20 Claims, 7 Drawing Sheets

(56) References Cited

U.S. PATENT DOCUMENTS

| | | | | |
|---|---|---|---|---|
| 9,314,074 | B2 | 4/2016 | Johnson | |
| D775,824 | S | 1/2017 | King | |
| D776,426 | S | 1/2017 | Smith | |
| D780,449 | S | 3/2017 | King | |
| 2009/0020570 | A1 | 1/2009 | Chan | |
| 2013/0206055 | A1* | 8/2013 | Moran Wexler | B42D 9/002 116/234 |
| 2016/0324283 | A1* | 11/2016 | Kane | A45C 1/06 |
| 2016/0327382 | A1* | 11/2016 | Beck | B65D 21/08 |
| 2017/0035169 | A1* | 2/2017 | Haarburger | A45C 1/06 |
| 2017/0055654 | A1 | 3/2017 | King | |

OTHER PUBLICATIONS

"Trayvax, Wallet for Life." Kick Finder, Showing the Best of Kickstarter. Jun. 8, 2013. Web. <https://kickinitforward.wordpress.com/2013/06/08/trayvax-wallet-for-life/>.

Trayvax Original Wallet, Front View [image], corresponding to wallet distributed on Oct. 31, 2013, via https://www.kickstarter.com/projects/1262752680/trayvax-wallet-for-life/posts/647452.

Trayvax Original Wallet, Back View [image], corresponding to wallet distributed on Oct. 31, 2013, via https://www.kickstarter.com/projects/1262752680/trayvax-wallet-for-life/posts/647452.

Trayvax Original Wallet, Top View [image], corresponding to wallet distributed on Oct. 31, 2013, via https://www.kickstartercom/projects/1262752680/trayvax-wallet-for-life/posts/647452.

Trayvax Original Wallet, Open View [image], corresponding to wallet distributed on Oct. 31, 2013, via https://www.kickstarter.com/projects/1262752680/trayvax-wallet-for-life/posts/647452.

Design U.S. Appl. No. 29/538,029, filed Aug. 31, 2015, now U.S. Pat. No. D775,824, dated Jan. 10, 2017, inventor Mark King.

Design U.S. Appl. No. 29/538,033, filed Aug. 31, 2015, now U.S. Pat. No. D780449, dated Mar. 7, 2017, inventor Mark King.

U.S. Appl. No. 15/251,304, filed Aug. 30, 2016, inventor Mark King.

* cited by examiner

ADJUSTABLE WALLET

CROSS REFERENCE TO RELATED APPLICATIONS

This application claims the benefit of U.S. Provisional Application No. 62/247,442, filed Oct. 28, 2015, titled "Adjustable Wallet," which is incorporated herein by reference in its entirety.

TECHNICAL FIELD

The present disclosure relates generally to a wallet, and more particularly to a durable and low profile utility wallet for carrying personal items.

BACKGROUND

Traditional billfolds or wallets, which can include bi-fold or tri-fold wallets formed of leather, canvas, nylon, or other material, are usually bulky. When stuffed with credit cards, money, receipts, or other personal items, traditional wallets become even thicker and hard to carry. In addition, when carried in a rear pocket, for example, sitting on such a large, bulky wallet can be uncomfortable. Sitting on such large, bulky wallets can even cause back problems in some users. Such bulky wallets are also hard to carry in a front pocket as well because of their size.

In addition to being bulky, traditional wallets made of leather or canvas, for example, tend to wear out over time. If the wear on a wallet becomes significant, the wallet can no longer securely hold the personal items of its owner.

A need thus exists for a thin, low profile wallet that is both durable and easy to carry. A need also exists for a lightweight wallet and a wallet that can adjust in size to accommodate the items of a user.

SUMMARY

In certain example aspects described herein, a wallet is provided, such as a utility wallet. The wallet comprises a plurality of plates, a plurality of straps and at least one cord. In one aspect, a first strap of the plurality of straps has an anchoring end coupled to a first plate, and a locking end configured to selectively engage a portion of a second plate and secure the wallet in a closed position. A second strap can be coupled to the second plate. The second plate can be constructed to interface with the second strap so as to hold objects such as personal items. The second plate includes a body having an anchoring slot, the anchoring slot being constructed so as to secure a first end of the second strap to a body of the second plate. A second end of the second strap can be secured to the rigid body by lacing the second end of the second strap through the plurality of lacing slots. The at least one cord can couple a distal end of the two plates together. In one aspect, the distance between the distal end of the first plate and the distal end of the second plate can be adjusted by changing the length of cord extending between the two plates. Thus, the user can change the volume of the wallet by adjusting the length of cord extending between the plates, and/or adjusting the length of the second strap.

These and other aspects, objects, features, and advantages of the example embodiments will become apparent to those having ordinary skill in the art upon consideration of the following detailed description of illustrated example embodiments. Related methods are also provided. Other apparatuses, methods, systems, features, and advantages of the wallet and the method of its use will be or become apparent to one with skill in the art upon examination of the following figures and detailed description. It is intended that all such additional apparatuses, methods, systems, features, and advantages be included within this description, be within the scope of the wallet and the method of its use, and be protected by the accompanying claims.

DESCRIPTION OF THE DRAWINGS

The accompanying drawings, which are incorporated in and constitute a part of this specification, illustrate certain aspects of the instant invention and together with the description, serve to explain, without limitation, the principles of the invention. Like reference characters used therein indicate like parts throughout the several drawings.

DETAILED DESCRIPTION OF THE EXAMPLE EMBODIMENTS

Figure 1:
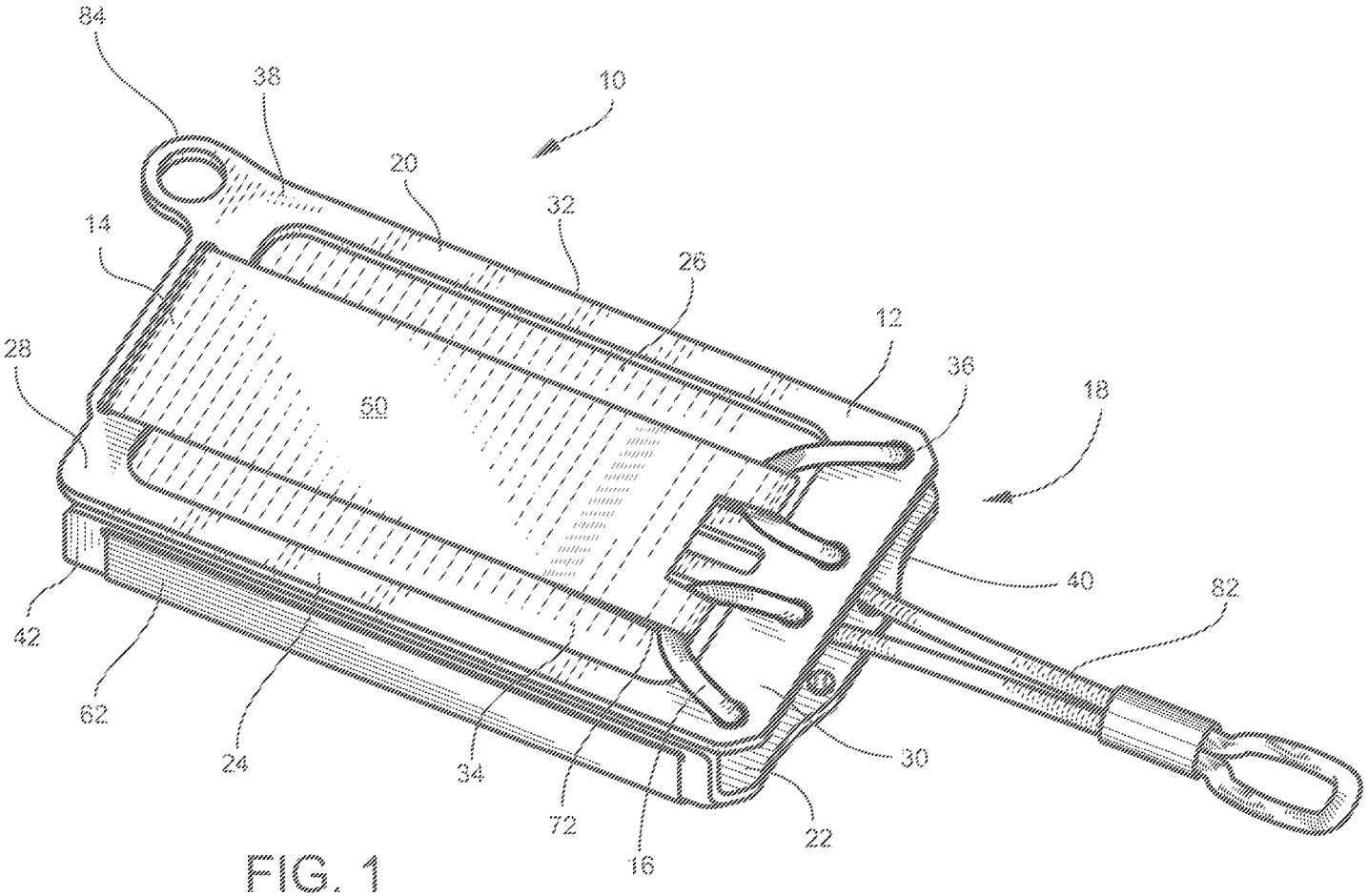
FIG. 1 is a front right perspective view of a wallet in a closed position, according to my design.
Figure 2:
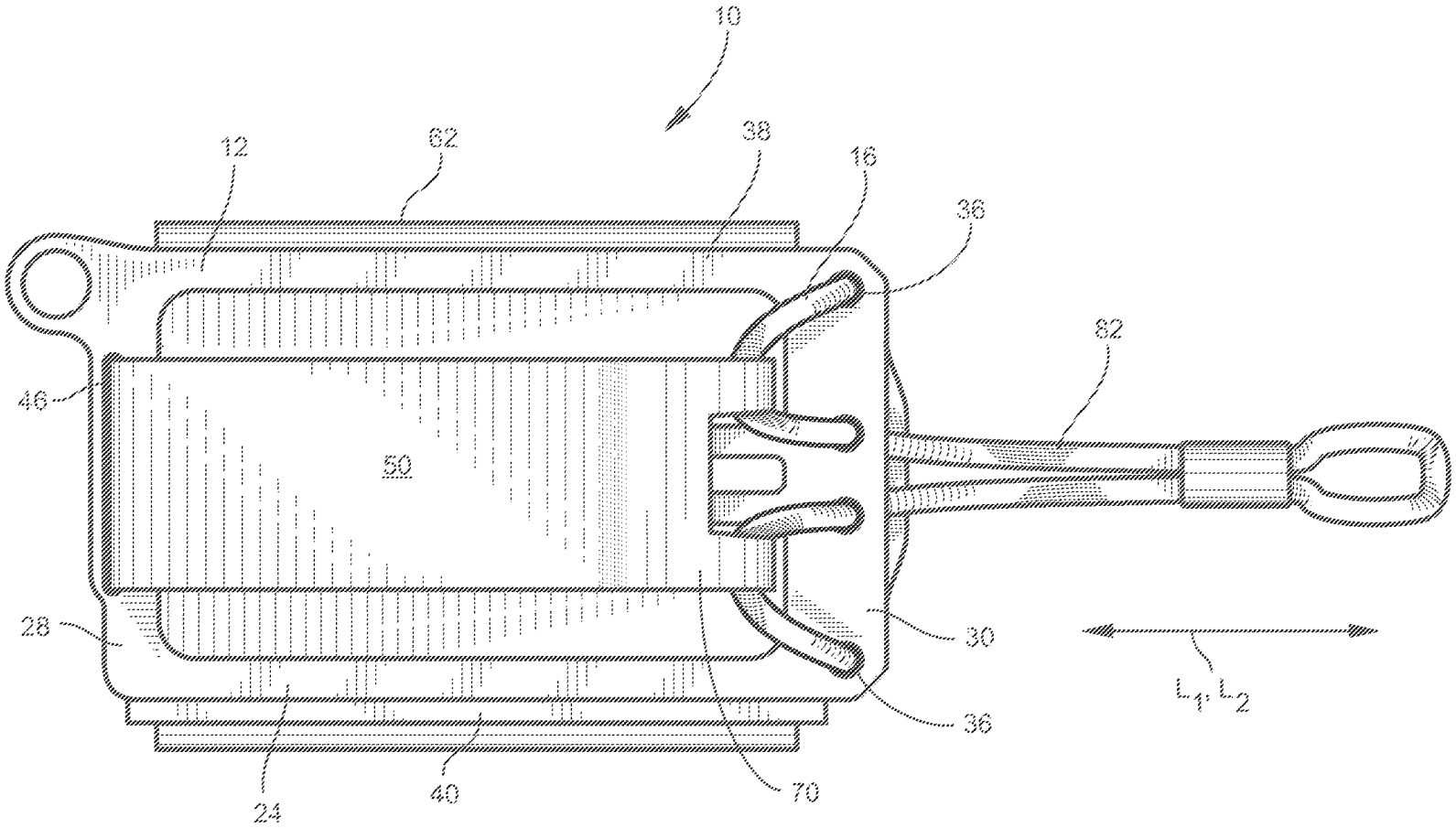
FIG. 2 is a front elevational view of the wallet of FIG. 1.
Figure 3:
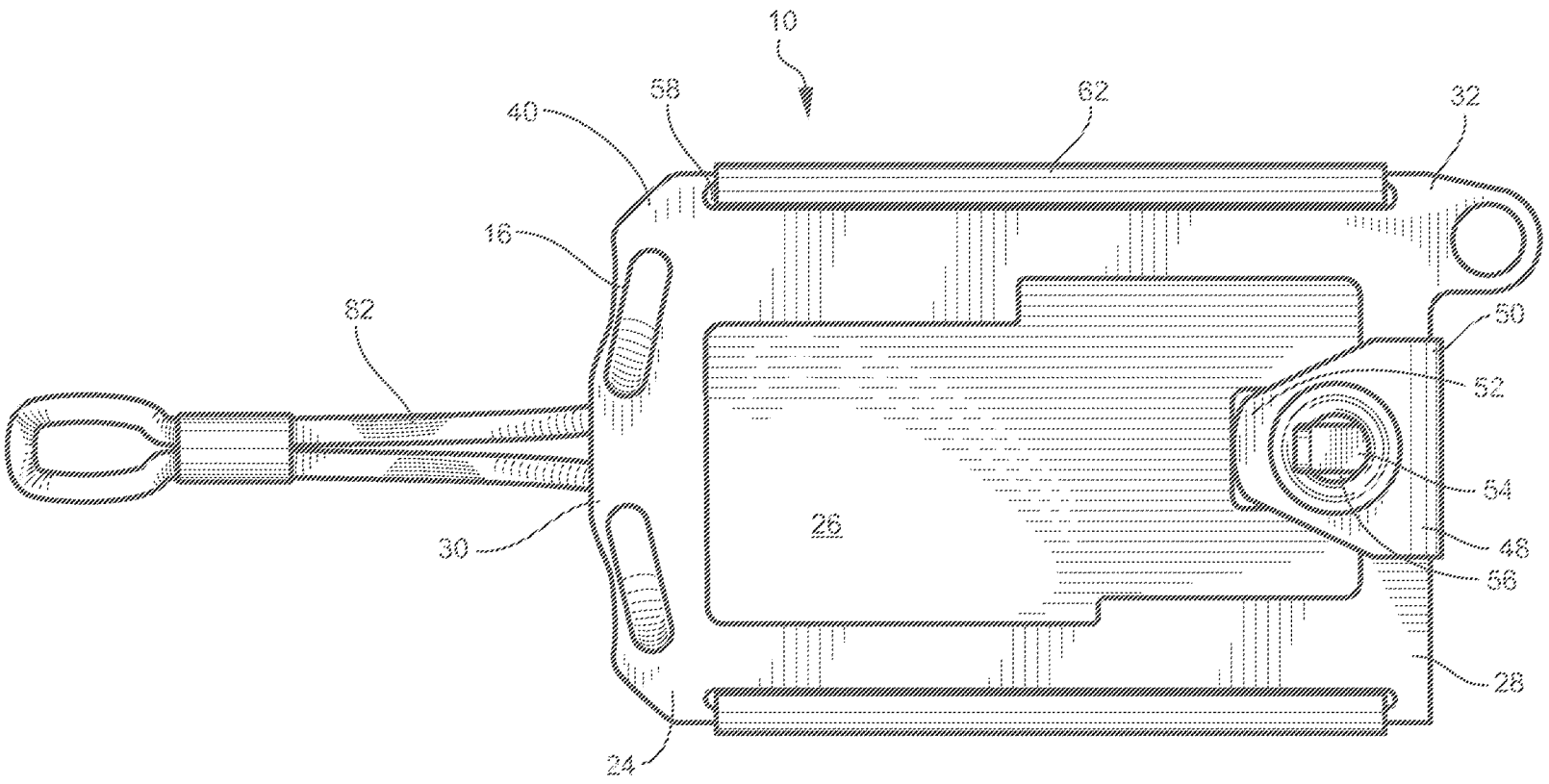
FIG. 3 is a rear elevational view of the wallet of FIG. 1.
Figure 4:
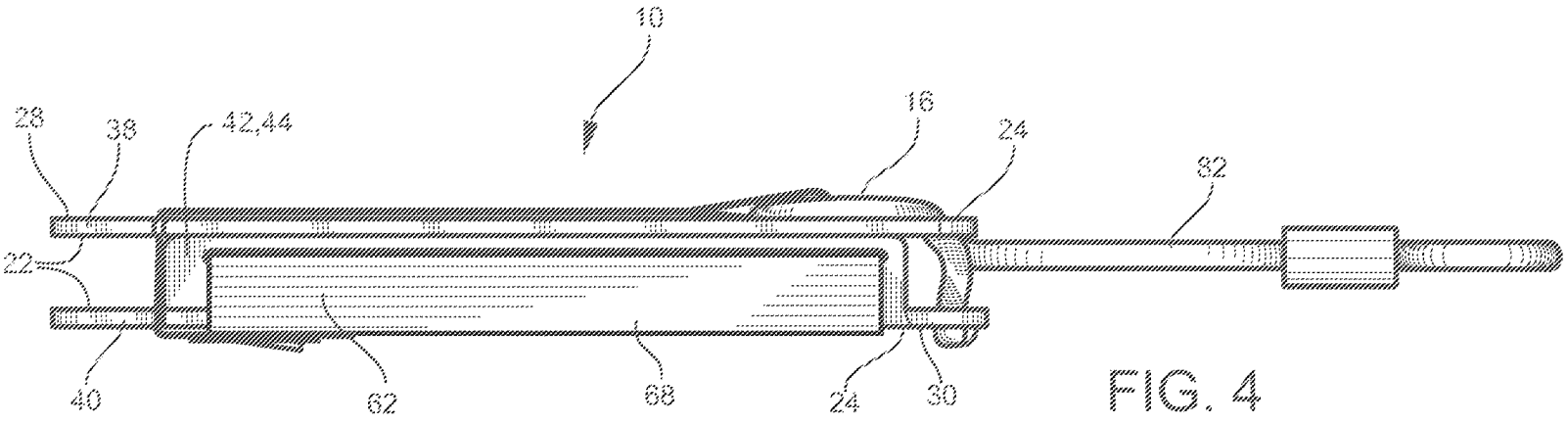
FIG. 4 is a bottom plan view of the wallet of FIG. 1.
Figure 5:
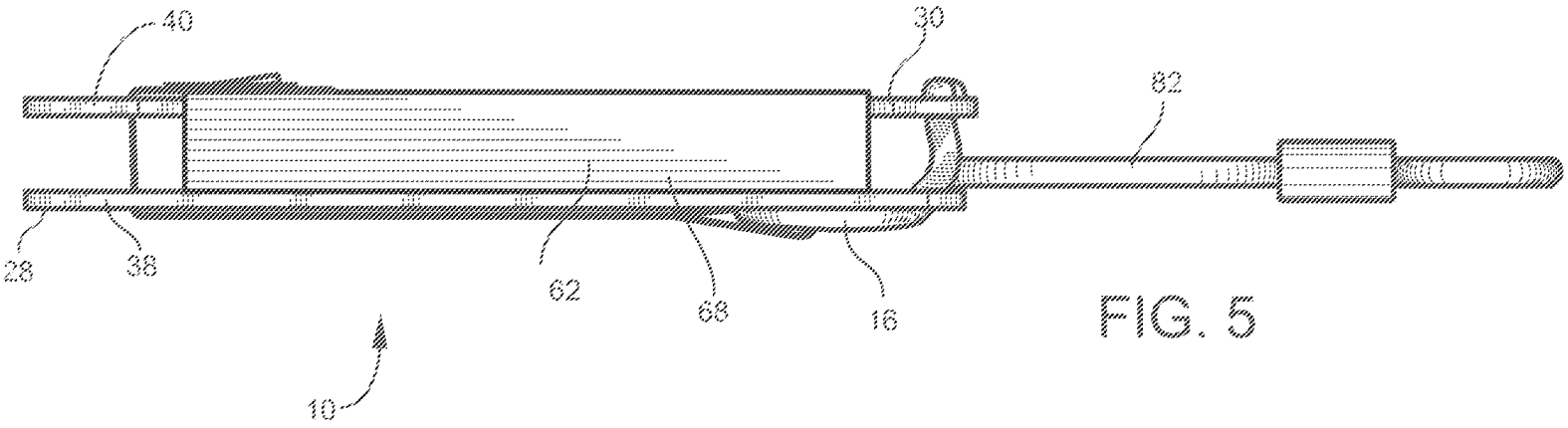
FIG. 5 is a top plan view of the wallet of FIG. 1.
Figure 6:
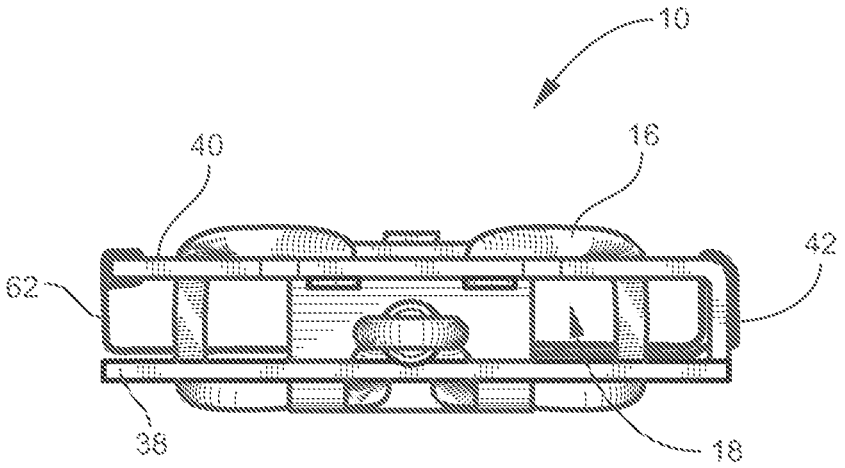
FIG. 6 is a right side elevational view of the wallet of FIG. 1.
Figure 7:
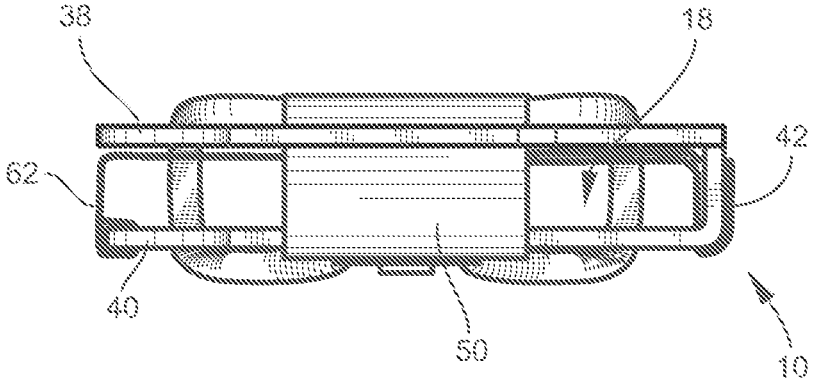
FIG. 7 is a left side elevational view of the wallet of FIG. 1.

The present invention can be understood more readily by reference to the following detailed description, examples, and claims, and their previous and following description. Before the present system, devices, and/or methods are disclosed and described, it is to be understood that this invention is not limited to the specific systems, devices, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known aspect. Those skilled in the relevant art will recognize that many changes can be made to the aspects described, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used herein, the singular forms "a," "an" and "the" include plural referents unless the context clearly dictates otherwise. Thus, for example, reference to a "strap" includes aspects having two or more straps unless the context clearly indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance can or cannot occur, and that the description includes instances where said event or circumstance occurs and instances where it does not.

Terms used herein, such as "exemplary" or "exemplified," are not meant to show preference, but rather to explain that the aspect discussed thereafter is merely one example of the aspect presented.

Additionally, as used herein, relative terms, such as "substantially", "generally", "approximately", and the like, are utilized herein to represent an inherent degree of uncertainty that can be attributed to any quantitative comparison, value, measurement, or other representation. These terms are also utilized herein to represent the degree by which a quantitative representation can vary from a stated reference without resulting in a change in the basic function of the subject matter at issue.

Example Embodiments

With reference to FIGS. 1-9, provided is a wallet 10 comprising a plurality of plates 12, a plurality of straps 14 and at least one cord 16. In use, the plurality of plates can be spaced from each other in an overlying relationship to form a wallet chamber 18. The straps and/or the cord can allow a user to expand or reduce the volume of the wallet chamber and selectively couple the plates 12 together to secure the contents of the wallet 10. As such, the wallet can be adjustable.

Each plate 12 of the plurality of rigid plates comprises a body 20 having an inner plate surface 22 and an opposed outer plate surface 24. In one aspect, the body of each plate can be a substantially flat body. Alternatively, at least a portion of the body 20 of each plate 12 can be curved or non-flat. In another aspect, each plate of the plurality of plates can be a rigid or substantially rigid plate 12. That is, the plates can be a relatively flat and rigid component of the wallet 10, the rigidity of which provides a support or frame for the wallet 10 so that tightening a strap 14, as described herein, secures personal items of the user between the plates 12. As a "rigid" plate, each plate 12 can have limited flexibility, inasmuch as the plate resists bending and deformation. As such, the plurality of plates 12 can be substantially stiff and inflexible, such that the plates can withstand tightening of the strap 14 as described herein. Optionally, at least a portion of a plate 12 can be flexible or non-rigid. In one aspect, when a lightweight wallet 10 is desired, at least one plate opening 26 can be defined in the plates. In this aspect, the at least one plate opening can be sized and shaped to reduce the amount of material required to form the plate 12 without reducing the structural integrity of the plates.

Each plate 12 of the plurality of plates has a proximal end 28 and an opposed distal end 30. An upper side 32 and an opposed lower side 34 can extend between the proximal end and the distal end of each plate. In one aspect, a plurality of bores 36 can be defined in a portion of the distal end 30 of each plate 12. The plurality of bores can extend from the inner surface 22 of each plate to the outer surface 24. In another aspect, the plurality of bores can be sized and shaped so that a portion of the cord 16 can be threaded through the plurality of bores 36. According to another aspect, the plurality of plates comprise a first plate 38 having a longitudinal axis $L_1$ and a second plate 40 having a longitudinal axis $L_2$.

In certain example embodiments, at least one plate of the plurality of plates 12 comprises at least one sidewall 42. In one aspect, the sidewall can extend away from the body 20 of the plate. That is, the body of the plate 12 can transition, at one or more edges, into one or more portions of the sidewall 42 that extend outward from the body 20. In another aspect, the at least one sidewall can extend away from the body of the plate 12 at an acute angle relative to the plane of the plate. Optionally, the at least one sidewall 42 can extend away from the body 20 of the plate 12 substantially transverse to the plane of the plate. For example, each plate 12 can comprise a proximal sidewall, a distal sidewall, an upper sidewall and/or a lower sidewall 44. As shown, the lower sidewall extends outward from the inner surface 22 of the body 20 of the second plate 40.

In certain example embodiments, each sidewall 42 of the plates 12 can be of varying length and can extend along all or a portion of a side of the plates. For example, the lower sidewall 44 can extend along all or a portion of the lower side 34 of the second plate 40. The sidewall can be arranged, for example, so as to aid in further securing personal items within the wallet 10. For example, the sidewall 42 can prevent personal items of the user from sliding out of the wallet 10 when such items are secured within the wallet.

In one aspect, the at least one sidewall 42 can also form at least part of the boundary of the chamber 18 of the wallet 10, within which the user can place personal items. For example, the chamber can be bound by the inner surface 22 of the first plate 38 and the second plate 40 and/or the at least one sidewall. The length and width of the chamber, for example, can be slightly larger than the length and width of a traditional credit card or personal identification card, thereby accommodating a traditional credit card. The depth of the compartment, for example, can be adjustable as described herein based on how tightly the user adjusts the plurality of straps 14 and/or the cord 16.

A locking slot 46 can be defined in a portion of the proximal end 28 of the first plate 38. In one aspect, the locking slot can have a slot axis that is substantially transverse to the longitudinal axis $L_1$ of the first plate. Optionally, the locking slot 46 can have a slot axis that is at an acute angle relative to the longitudinal axis of the first plate 38. The locking slot, for example, can be configured to accommodate a first, locking end 48 of a first strap 50 of the plurality of straps that is to be attached to the first plate. That is, the locking slot 46 can be sized and shaped so that the locking end of the first strap can pass through the locking slot of the first plate 38. For example, the locking end 48 of the first strap 50 can pass through the locking slot 46 and can be restricted from sliding back through the locking slot, such as by increasing the thickness of the first strap on a leading edge 52 of the locking end 48 of the strap that has passed through the locking slot 46. In another example, a locking ring 54 having a thickness greater than the locking slot thickness can be positioned in the locking end 48 of the first strap 50. In this example, the locking ring can prevent the locking end of the first strap for passing through the locking slot 46 and can provide an attachment point for a latch 56, described more fully below.

In one aspect, an anchoring slot 58 can be defined in a portion of the upper side 32 of the second plate 40. In this aspect, the anchoring slot can have a slot axis that is substantially parallel to the longitudinal axis $L_2$ of the second plate. Optionally, the anchoring slot 58 can have a slot axis that is at an acute angle relative to the longitudinal axis of the second plate 40. The anchoring slot, for example, can be configured to accommodate a first, anchoring end 60 of a second strap 62 of the plurality of straps 14 that is to be anchored to the second plate. That is, the anchoring slot 58 can be sized and shaped to securedly attach the anchoring end 60 of the second strap to the second plate 40. For example, the anchoring end of the second strap 62 can pass through the anchoring slot 58 and can be anchored to the second plate, such as by increasing the thickness of the second strap on a leading edge 64 of the anchoring end 60 of the second strap that has passed through the anchoring slot 58. If the second strap is a polymer-based strap, for example, the leading edge of the anchoring end 60 of the second strap 62 can be passed through the anchoring slot and then melted so that the leading edge 64 of the anchoring end 60 is wider than the anchoring slot 58. In another aspect, the latch 56 can be positioned on the outer surface 24 of the proximal end 28 of the second plate 40. In this aspect, the latch can be configured to securedly, selectively attach to a portion of a strap 14 of the wallet.

In one aspect, a series of lacing slots 66 can be defined in a portion of the sidewall 42 and/or the body 20 of the plate 12. For example, the series of lacing slots can be defined in a portion of the sidewall of at least one of the first plate 38 and the second plate 40. In another example, the series of lacing slots 66 can be defined in a portion of the body 20 of the first plate and/or the second plate. Optionally, at least one lacing slot of the series of lacing slots 66 can be defined in a portion of the body of a plate 12, and at least one lacing slot of the series of lacing slots can be defined in a portion of the sidewall 42. In another aspect, the series of lacing slots 66 can comprise at least two slots positioned adjacent and substantially parallel to each other. For example, the lacing slots 66 can have a longitudinal axis substantially parallel to each other and the longitudinal axes $L_1$, $L_2$ of the respective first and/or second plates. In use, the lacing slots can be configured to receive a lacing end 68 of a strap 14 therein. As illustrated herein, for example, the lacing end of the second strap 62 laces in and out of the lacing slots 66, such as in a weaving pattern, so that the lacing end 68 of the second strap secures the lacing end of the second strap 62 to the second plate 40.

As those skilled in the art will appreciate, the plurality of plates 12 can be constructed of a variety of materials, such as substantially rigid materials like metal, a metal alloy, wood, hard polymer such as a hard plastic, carbon fibers, or other substantially rigid material or combinations thereof. For example, the plates 12 can be constructed from steel, aluminum, brass, or combinations thereof. In certain example embodiments, such as when a lightweight wallet 10 is desired, the plates can be constructed of aluminum or other lightweight metal. In certain example embodiments, the plates 12 can be painted or powder coated. By using a plate such as a metal plate, the wallet 10 as described herein can be a durable wallet.

The plurality of straps 14 comprise the first strap 50 and the second strap 62. Each strap of the plurality of straps has a first end, an opposed second end and a strap body extending therebetween. In one aspect, the strap body can be adjustable by the user to increase or decrease the usable length of the strap. For example, the body of the second strap can be decreased by pulling more of the strap through the lacing slots 66. As previously discussed, the first strap can be coupled to the first plate 38, and the second strap can be coupled to the second plate 40. For example, the locking end 48 of the first strap 50 can be positioned in the locking slot 46 of the first plate. An opposed anchoring end 70 of the first strap can be formed into a loop 72 that can be anchored to the first plate by the at least one cord 16. That is, a loop can be formed in the anchoring end of the first strap 50 by folding the anchoring end 70 upon itself and securing the folded portion with stitching or adhesive. In other example embodiments, the loop 72 of the anchoring end of the first strap 50 can be formed by folding the anchoring end 70 upon itself and securing with other fastening means, such as, for example and without limitation, a cap, snap, clasp, hook, stitching, Velcro, button.

The plurality of straps 14 can be made of any fabric or material, including synthetic polymers such as nylon. In certain example embodiments, at least one strap can be non-elastic whereas in other embodiments at least one strap can be an elastic strap. In certain example embodiments, at least one strap 14 can include other components, such as buckles, claps, or grommets. For example, the body of at least one strap can include a buckle. In one aspect, each strap 14 of the plurality of straps can be a substantially flat strap. Optionally, at least one strap 14 of the plurality of straps can have another cross-sectional shape, such as substantially round or oval. If the strap 14 is a substantially flat strap, the strap can have a flat and rectangular cross-sectional shape and an elongated rectangular top profile. Such a configuration, for example, can allow the strap 14 to apply a more-even compressive force when tightened around personal items of the user in the wallet 10.

In certain example embodiments, other means can be used to increase the thickness of a strap 14 on the end of the strap that has passed through an anchoring slot 58, a lacing slot 66 and the like. For example, the anchoring end of a strap can be folded upon itself and securing the folded portion with stitching or adhesive. By making the anchoring end 60, 70 of a strap wider than the anchoring slot of a plate 12, the anchoring end of the strap cannot pass back through the anchoring slot. In another example, the anchoring end 60, 70 of the first strap 50 and/or the second strap 62 can be anchored to the respective first and second plate by a fastening means, such as a cap, snap, clasp, hook, stitching, Velcro, button, or other means or fastener that can or cannot also require an anchoring slot. For example, the anchoring end can be passed through the anchoring slot, and then a cap can be attached to the anchoring end, thereby preventing the anchoring end 60, 70 from slipping back through the anchoring slot. That is, the cap can be arranged so as to anchor the anchoring end of the strap to the first plate or the second plate via the anchoring slot.

In one aspect, the at least one cord 16 can couple the distal end 30 of the first plate 38 to the distal end of the second plate 40. For example, a portion of the cord can be threaded through a bore 36 of the first plate, and a portion of the cord can be threaded through a bore of the second plate. In another aspect, a first end 74 of the cord 16 can be anchored to a first inner bore 76 of the second plate 40 and a second end 78 of the cord can be anchored to a second inner bore 80 of the second plate. Between the first end and the second end, the cord 16 can be laced or woven through at least one of the remaining bores of the first and second plates. In this aspect, a portion of the cord can be threaded through the loop 72 formed in the anchoring end 70 of the first strap 50. The first end 74 of the cord can be anchored to the first inner bore 76 of the second plate, and the second end 78 of the cord can be anchored to the second inner bore 80 of the second plate by increasing the thickness of the cord that has passed through the respective inner bore. For example, if the cord is a polymer-based cord, for example, the first end and the second end of the cord can be passed through the respective inner bore and then melted so that the ends of the cord are wider than the bores. Though not illustrated, it is of course contemplated that many different lacing patterns can be used to couple the distal end 30 of the first plate 38 to the distal end of the second plate 40. In another aspect, a central lanyard portion 82 of the cord can extend away from the plates 12. In this aspect, the lanyard can provide an easy means to hold the wallet. Also, however, the lanyard portion 82 can contain slack in the cord that the user can use to adjust the thickness of the wallet 10.

The at least one cord 16 can be a lightweight rope such as paracord and the like. In one aspect, the cord can be formed form polymeric materials such as, for example and without limitation, nylon and polyester. In another aspect, the cord 16 can have a diameter less than the diameter of the bores 36 of the plates 12. Optionally, the cord can be sized to frictionally engage a diameter wall of the bores of the plate 12.

To assemble the wallet 10 of the present application, the distal end 30 of the first plate 38 can be coupled to the distal end of the second plate 40 with the at least one cord 16 as described above. The first strap 50 can be attached to the first plate with the loop 72 of the anchoring end 60 of the first strap held in place by the cord and the locking end 48 of the first strap held in place by the locking slot 46. The second strap 62 can be attached to the second plate 40 with the anchoring end 70 of the second strap positioned in the anchoring slot 58 of the second plate 40, and the lacing end 68 of the second strap threaded through the lacing slots 66.

Figure 8:
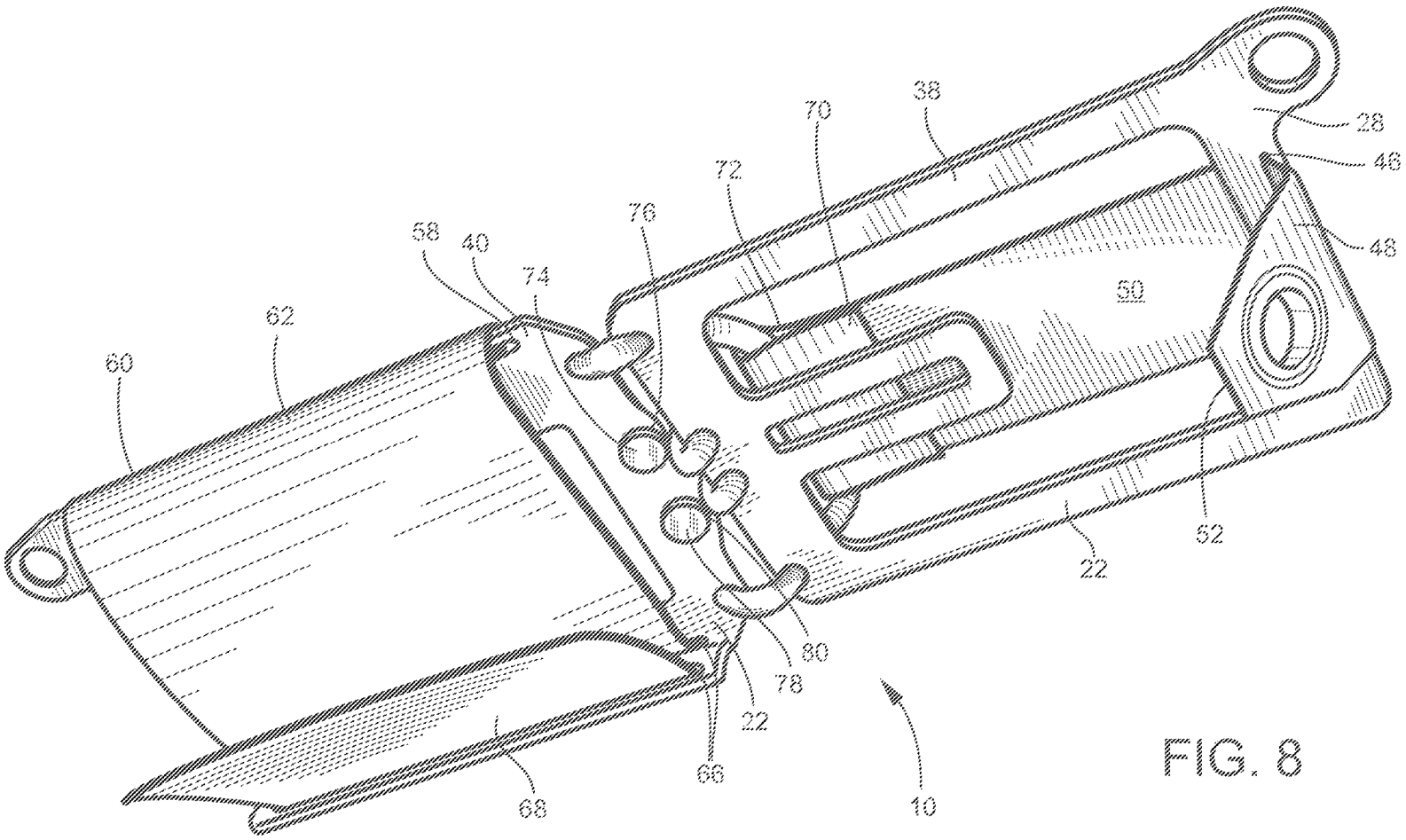
FIG. 8 is a front perspective of the wallet of FIG. 1 in an open position.

Hence, in certain example embodiments, the second strap 62 can extend over the upper side 32 of the second plate 40. That is, the second strap can extend in a direction substantially transverse to the longitudinal axis $L_2$ of the second plate. As shown, the body of the second strap 62 wraps upwards and over the top of the wallet 10 (FIG. 8). The second strap then wraps downwards through the lacing slots 66 located on a portion of the sidewall 42 of the second plate. As such, the second strap 62 interfaces with the second plate 40. In certain example embodiments, the first strap 50 can extend in a direction substantially parallel to the longitudinal axis $L_1$ of the first plate 38.

Figure 9:
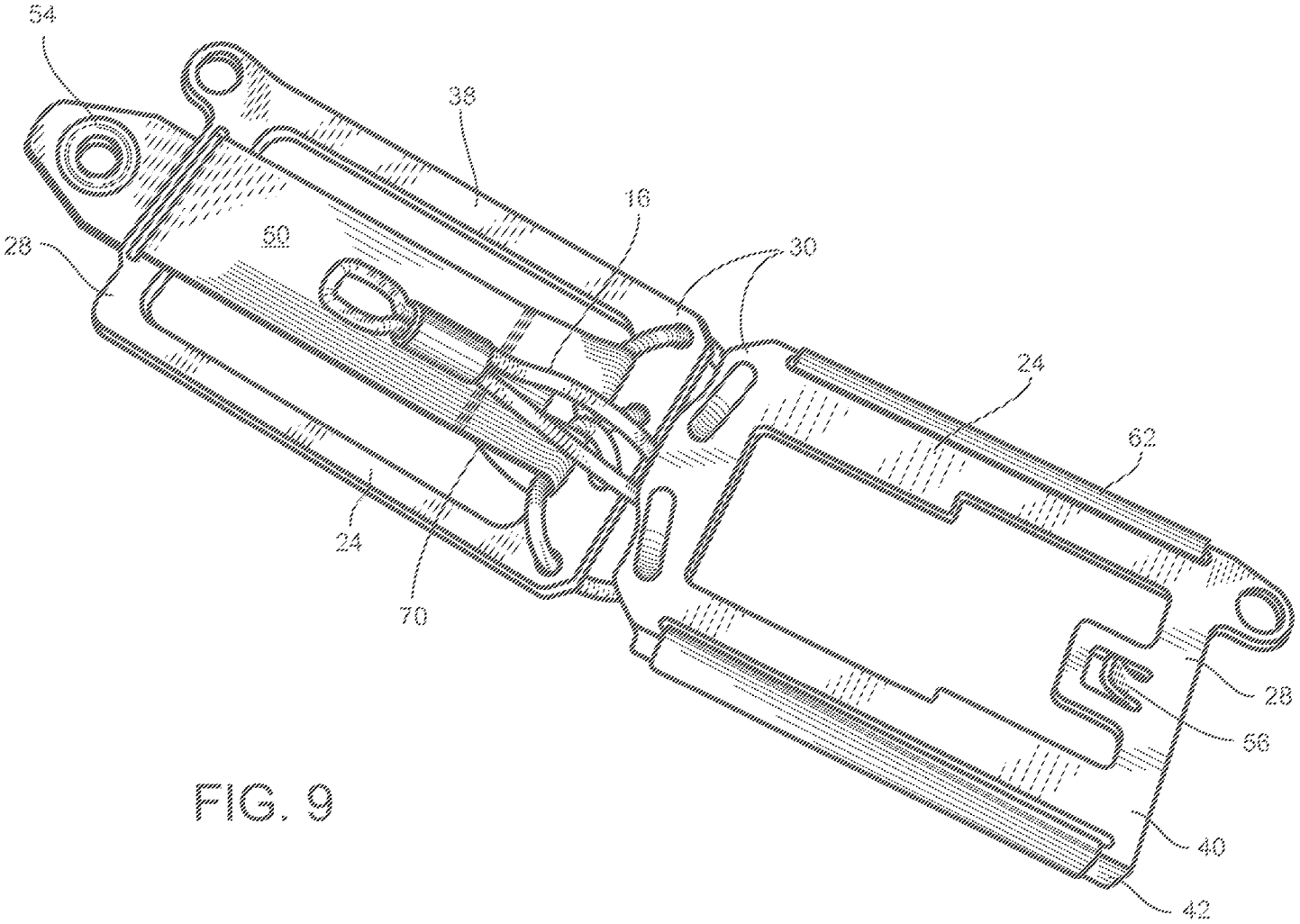
FIG. 9 is a rear perspective view of the wallet of FIG. 1 in the open position.

The assembled wallet 10 can be rotated about and between an open wallet position as shown in FIGS. 8 and 9, and a closed wallet position as shown in FIGS. 1-7. In the closed wallet position, the distal end 30 of the first plate 38 can overlie at least a portion of the distal end of the second plate 40, and the proximal end 28 of the first plate can overlie at least a portion of the proximal end of the second plate. In the open wallet position, the first plate 38 and/or the second plate 40 can be rotated away from the other plate so that the distal end 30 of the first plate 38 is adjacent to the distal end of the second plate 40 and the proximal end 28 of the first plate is spaced from the proximal end of the second plate.

To use the wallet 10, the volume of the wallet chamber 18 can be selectively adjusted by the user as necessary to secure the items in the wallet. For example, the volume of the wallet 10 can be adjustable about and between a first unexpanded position, in which the wallet chamber 18 has a first volume, and a second expanded position in which the wallet chamber has a second volume that is greater than the first volume.

For example, to expand the wallet chamber 18 towards the second expanded position, the user can slide a predetermined amount of cord 16 from the lanyard portion 82 through the bores 36 of at least one of the first plate 38 and the second plate 40. This can provide additional cord extending between the plates, which allows the distal ends 30 of the plates to move apart relative to each other, thereby increasing the volume of the wallet chamber. Because the first strap 50 is coupled to the cord 16, adjustment of the amount of cord extending between the plates 12 can allow the first strap to couple the proximal end 28 of the plates together, regardless of the volume of the wallet chamber 18. For example, in the second position, additional cord from the lanyard portion can be extended through the loop 72 of the first strap so that the locking end 48 of the first strap 50 can reach farther and engage the latch 56 to secure the wallet 10. Thus, while the bores 36 of the plates secure the cord to the plates, the bores are configured so that the cord can be pulled through the lacing slots bores in either direction, while maintaining enough friction on the cord so that the cord does not undesirably slide through the bores.

To contract the wallet chamber 18 towards the first unexpanded position, the user can slide a predetermined amount of cord 16 extending between the plates 12 through the bores 36 of at least one of the first plate 38 and the second plate 40 so that the lanyard portion 82 of the cord is longer. This can require the distal ends 30 of the plates to move closer relative to each other, thereby decreasing the volume of the wallet chamber 18.

The second strap 62 can be also be adjusted to securedly contain the personal items of the user. Because of the configuration of the lacing slots 66, the user can adjust the length of the second strap extending over the inner surface 22 of the second plate 40 by pulling or loosening the lacing end 68 of the second strap 62 extending through the lacing slots. That is, while the lacing slots 66 of the second plate 40 secure the second strap to the second plate, the lacing slots 66 are configured so that the second strap 62 can be pulled through the lacing slots 66 in either direction, while maintaining enough friction on the second strap so that the lacing end 68 of the second strap 62 is secured to the second plate 40. As such, adjusting the second strap allows for tightening or loosening the strap, which thereby permits the user to adjust the volume of the wallet chamber 18 and the personal items the wallet 10 may accommodate. For example, the user may shorten the body of the second strap 62 extending around the inner surface of the second plate 40 by pulling on the lacing end, thereby tightening the second strap.

In use, the user can store paper money, credit cards and/or personal items in the wallet chamber 18. To secure the money, cards and items within the wallet chamber, the user can, if desired, first adjust the length of the body of the second strap 62 so that the second strap applies a predetermined amount of force to the items, securing the items in place relative to the second plate 40. The user can then, if desired, adjust the amount of cord 16 extending between the plates so that the wallet chamber 18 has a predetermined volume and the locking end 48 of the first strap can keep the wallet closed when the locking ring 54 of the first strap engages the latch 56. Of course, these steps can be reversed and the user can adjust the cord 16 before adjusting the second strap 62.

Personal items of the user are also secured within the wallet and against the at least one of the plate 12 by the second strap 62. In one aspect, the first strap 50 couples the proximal ends 28 of the plates 12 so that the wallet 10 can be selectively, securedly closed by the user while the second strap 62 secures the items within the wallet chamber 18. For example, the second strap is anchored to the wallet 10 by extending one end of the second strap through the anchoring slot located on the second plate 40. The second strap then extends over the inner surface 22 of the second plate, including over any contents of the wallet. The other end of the second strap is then woven or laced, for example, through the lacing slots 66 on the opposed side of the wallet. By pulling on the end of the second strap 62 that extends through the lacing slots, the user can adjust the length of the second strap and thereby tighten or loosen the second strap 62. For example, a user can tighten the second strap, thereby more firmly securing any personal items against the second plate 40. If the user needs to add personal items to the wallet, for example, the user can loosen the second strap 62, add the items, and then tighten the strap against the personal items and the rigid support. The second plate, for example, provides support for tightening the second strap against the contents of the wallet. Further, the configuration of the lacing slots allows, for example, the second strap 62 to stay in a tightened or loosened position until the user adjusts the second strap.

As with the second strap 62, the length of the cord 16 extending between the plates 12 can be adjusted. For example, by pulling on the lanyard portion 82 of the cord, the user can adjust the length of the cord 16 extending between the first plate 38 and the second plate 40, and thereby increase or decrease the maximum distance between the distal end 30 of the plates. For example, a user can pull the lanyard portion in a first direction to shorten the maximum distance, thereby more firmly securing any personal items against one of the plates. If the user needs to add personal items to the wallet, for example, the user can pull the lanyard portion in a second direction that is opposed to the first direction to increase the maximum distance, add the items, and then tighten the cord against the personal items.

In certain example embodiments, the wallet 10 as described herein can comprise other features. For example, at least one of the plates 12 can comprise an open ring 84 that can be used for a variety of purposes. A user can use the open ring, for example, to attach the wallet 10 to keys, backpack, purse, or other belongings of the user. In certain example embodiments, the plate can be equipped with a bottle opener or a serrated edge (not shown).

In certain example embodiments, at least one plate 12 can provide Radio Frequency Identification (RFID) blocking. For example, certain credit cards or personal identification cards include embedded RFID chips containing personal information. When at least one plate 12 is constructed of metal, for example, the plate can block unauthorized access to the RFID-based chip, thereby preventing theft of the user's personal credit card information or other personal information. Additionally or alternatively, RFID blocking can be enhanced or achieved by inserting a metal card, such as a metal card shaped like a credit card, into the wallet 10 as described herein. For example, a user can insert personal items into the wallet, and then insert the metal card on the outside personal items such that the personal items are sandwiched between the card and at least one plate 12. Having metal on both sides of any personal items containing an RFID chip, for example, enhances or achieves RFID blocking with the wallet as described herein.

By configuring the wallet 10 in accordance with the example embodiments described herein, a low profile and durable wallet is provided. The wallet 10 is also easy to use, lightweight, and adjustable. And, when desired, the wallet 10 can also provide RFID blocking.

Although several aspects of the invention have been disclosed in the foregoing specification, it is understood by those skilled in the art that many modifications and other aspects of the invention will come to mind to which the invention pertains, having the benefit of the teaching presented in the foregoing description and associated drawings. It is thus understood that the invention is not limited to the specific aspects disclosed hereinabove, and that many modifications and other aspects are intended to be included within the scope of the appended claims. Moreover, although specific terms are employed herein, as well as in the claims that follow, they are used only in a generic and descriptive sense, and not for the purposes of limiting the described invention.

What is claimed is:

1. A wallet comprising:

a plurality of straps, each strap having a first end, an opposed second end and a strap body extending therebetween, wherein the plurality of straps comprise a first strap and a second strap;

a plurality of plates, each plate having a longitudinal axis, an inner plate surface and an opposed outer plate surface, a proximal end and an opposed distal end, and an upper side and an opposed lower side extending between the proximal end and the distal end of the each plate, wherein a plurality of bores are defined in a portion of the distal end of each plate from the inner plate surface to the outer plate surface, and wherein the plurality of plates comprise:

a first plate configured to interface with the first strap; and a second plate configured to interface with the second strap, wherein an anchoring slot is defined in a portion of the second plate that is configured to secure the first end of the second strap to the second plate, and wherein a series of lacing slots is defined in a portion of the second plate that is configured to secure the second end of the second strap to the second plate by lacing the second end of the second strap through the lacing slots; and at least one cord extending through at least one bore of the plurality of bores of each plate, the at least one cord configured to selectively, adjustably couple the distal end of the first plate to the distal end of the second plate, wherein the at least one cord secures the first end of the first strap to the first plate;

wherein a length of the body of the second strap is selectively adjustable by adjusting the amount of the second strap laced through the lacing slots, wherein the second end of the first strap is selectively engageable to a latch of the second plate to maintain the wallet in a closed position, and wherein the volume of the wallet is selectively adjustable by the user about and between a first unexpanded position, in which the wallet has a first volume, and a second expanded position in which the wallet has a second volume that is greater than the first volume.

2. The wallet of claim 1, wherein the plurality of lacing slots are parallel to each other.

3. The wallet of claim 1, wherein the plurality of straps are nylon straps.

4. The wallet of claim 1, wherein at least one of the first plate and the second plate is a rigid plate.

5. The wallet of claim 1, wherein each strap of the plurality of straps is a substantially flat strap.

6. The wallet of claim 1, wherein the first end of the second strap comprises a cap, the cap being configured to anchor the first end of the second strap to the second plate.

7. The wallet of claim 1, wherein pulling the second end of the second strap through the plurality of lacing slots shortens the length of the body of the second strap.

8. The wallet of claim 1, wherein at least one of the first plate and the second comprises an RFID-blocking material.

9. The wallet of claim 1, wherein a portion of the cord is threaded through a bore of the first plate, and a portion of the cord is threaded through a bore of the second plate.

10. The wallet of claim 9, wherein a first end of the cord is anchored to a first inner bore of the second plate, and a second end of the cord is anchored to a second inner bore of the second plate and wherein a central portion of the cord is laced through at least one of the remaining bores of the first and second plates.

11. The wallet of claim 10, wherein a lanyard portion of the cord contains slack in the cord that is usable to adjust the thickness of the wallet.

12. The wallet of claim 11, wherein pulling the lanyard portion in a first direction shortens a maximum distance between the distal end of the plates and pulling the lanyard portion in a second direction that is opposed to the first direction lengthens the maximum distance between the distal end of the plates.

13. A wallet comprising:

a first plate having a proximal end and an opposed distal end, wherein a plurality of bores are defined in a portion of the distal end;

a first strap having a first end, an opposed second end and a strap body extending therebetween, wherein at least a portion of the first strap is coupled to the first plate;

a second plate having a proximal end and an opposed distal end, wherein a plurality of bores are defined in a portion of the distal end of the second plate, wherein an anchoring slot is defined in a portion of the second plate, and wherein a series of lacing slots is defined in a portion of the second plate;

a second strap having a first end, an opposed second end and a strap body extending therebetween, wherein the first end of the second strap is secured to the second plate by threading the first end through the anchoring slot, wherein the second end of the second strap is secured to the second plate by lacing the second end of the second strap through the lacing slots and wherein a length of the body of the second strap is selectively adjustable by adjusting the amount of the second strap laced through the lacing slots; and at least one cord extending through at least one bore of the plurality of bores of each plate to couple the distal end of the first plate to the distal end of the second plate.

14. The wallet of claim 13, wherein the at least one cord selectively, adjustably couples the distal end of the first plate to the distal end of the second plate.

15. The wallet of claim 14, wherein a first end of the cord is anchored to a first inner bore of the second plate, and a second end of the cord is anchored to a second inner bore of the second plate, and wherein a central portion of the cord is laced through at least one of the remaining bores of the first and second plates.

16. The wallet of claim 15, wherein a lanyard portion of the cord contains slack in the cord that is usable to adjust the thickness of the wallet.

17. The wallet of claim 16, wherein pulling the lanyard portion in a first direction shortens a maximum distance between the distal end of the plates and pulling the lanyard portion in a second direction that is opposed to the first direction lengthens the maximum distance between the distal end of the plates.

18. The wallet of claim 13, wherein the at least one cord secures the first end of the first strap to the first plate.

19. The wallet of claim 18, wherein the second end of the first strap is selectively engageable to a latch of the second plate to maintain the wallet in a closed position.

20. The wallet of claim 13, wherein the volume of the wallet is selectively adjustable about and between a first unexpanded position, in which the wallet has a first volume, and a second expanded position in which the wallet has a second volume that is greater than the first volume.

* * * * *